US005509976A

United States Patent [19]

Yamazaki et al.

[11] Patent Number: 5,509,976

[45] Date of Patent: Apr. 23, 1996

[54] METHOD FOR PRODUCING A GRAIN-ORIENTED ELECTRICAL STEEL SHEET HAVING A MIRROR SURFACE AND IMPROVED CORE LOSS

[75] Inventors: Shuichi Yamazaki; Yoshiyuki Ushigami, both of Futtsu; Hiroyasu Fujii, Kitakyushu; Kenichi Murakami, Futtsu, all of Japan

[73] Assignee: Nippon Steel Corporation, Tokyo, Japan

[21] Appl. No.: 503,112

[22] Filed: Jul. 17, 1995

[51] Int. Cl.[6] ..... H01F 1/14

[52] U.S. Cl. ..... 148/113

[58] Field of Search ..... 148/111, 113, 148/122

[56] References Cited

U.S. PATENT DOCUMENTS

| | | | |
|---|---|---|---|
| 3,785,882 | 1/1974 | Jackson | 148/113 |
| 3,932,236 | 1/1976 | Wada et al. | 148/113 |
| 3,941,621 | 3/1976 | Lee et al. | 148/113 |
| 4,293,350 | 10/1981 | Ichiyama et al. | 148/111 |

FOREIGN PATENT DOCUMENTS

| | | | |
|---|---|---|---|
| 49-96920 | 9/1974 | Japan . | |
| 52-24499 | 7/1977 | Japan . | |
| 54-66320 | 5/1979 | Japan . | |
| 55-18566A | 2/1980 | Japan . | |
| 60-39123A | 2/1985 | Japan . | |
| 61-117218A | 6/1986 | Japan . | |
| 61-190021 | 8/1986 | Japan | 148/113 |
| 6-17137 | 1/1994 | Japan | 148/111 |
| 6256848A | 9/1994 | Japan . | |

OTHER PUBLICATIONS

Journal of Applied Physics, 53(11), Nov. 1982, pp. 8296–8298.

*Primary Examiner*—John Sheehan

*Attorney, Agent, or Firm*—Kenyon & Kenyon

[57] ABSTRACT

Disclosed is a method for producing a grain-oriented electrical steel sheet having mirror surface containing 0.8 to 4.8% of Si in the form of a strip which has been subjected to a conventional series of operations including hot rolling with or without annealing, cold rolling once or at least twice with intermediate annealing to obtain a final thickness, decarburization annealing with or without nitriding treatment, coating the steel sheet with an annealing separator mainly containing non-hydrating oxide and final annealing, the improvement comprising:

satisfying the relationship $[A]>0.2\times[O]$ where [A] is the total concentration of alkali metal impurity in the annealing separator (weight %), and

[O] is the amount of oxygen contained in the steel sheet just prior to the final annealing ($g/m^2$).

7 Claims, 3 Drawing Sheets

10μm

METHOD FOR PRODUCING A GRAIN-ORIENTED ELECTRICAL STEEL SHEET HAVING A MIRROR SURFACE AND IMPROVED CORE LOSS

BACKGROUND OF THE INVENTION

1. Field of the Invention

The present invention relates to a method for the production of a grain-oriented electrical steel sheet used as an iron core of a transformer or other electric appliances. More particularly, the present invention relates to a method for the production of a grain-oriented electrical steel sheet in which core loss is reduced by imparting it with a mirror surface and keeping it free of precipitates at the surface region.

2. Description of the Prior Art

Grain-oriented electrical steel sheet material for use in various types of electric equipment, mainly transformers, contains 0.8–4.8% Si and has a crystal texture preferentially aligned in the {110}<001> orientation. The required characteristics of a grain-oriented electrical steel sheet are a high magnetic flux density and a low core loss, which are represented by $B_8$ and $W_{17/50}$, respectively. A material for iron cores showing low electric power loss, i.e., a grain-oriented electrical steel sheet having low core loss, is strongly desired from the point of view of environmental protection and energy conservation.

Core loss can be subdivided into eddy current loss and hysterisis loss. The former decreases in proportion to reductions in the width of the magnetic domains of the steel sheet, and the later can be reduced by eliminating hindrances to the movement of magnetic domain walls. Primary causes of this hindrance are uneven or rough surfaces of the steel sheet and the presence of precipitates near the steel surface.

In industrial production of a grain-oriented electrical steel sheet having low core loss, priority had been given to the development of techniques for the magnetic domain refinement. For example, in the case of materials for use in stacked cores, partial or linear microstrains are applied to the final annealed steel sheet by laser-beam irradiation, as disclosed in Japanese Unexamined Patent Publication (Kokai) No. 55-18566. Also, in the case of materials for use in wound cores, stress relief annealing is applied to the fabricated core without imparting the effect of the magnetic domain refinement, as disclosed in Japanese Unexamined Patent Publication (Kokai) No. 61-117218. According to the above processes, the overall core loss is reduced due to a large decrease in eddy current loss.

On the other hand, various methods for producing a grain-oriented electrical steel sheet having low hysterisis loss at low cost have been proposed. These are directed to obtaining an even and smooth, or mirror-like, steel surface (hereinafter called a "mirror steel surface"). However, commercial production using these methods has not been realized.

The following describes various conventional proposals for reducing hysterisis loss and explains why these were not commercialized.

An inner oxide layer mainly composed of $SiO_2$ and a glass film mainly composed of forsterite ($Mg_2SiO_4$) are present on the surface of a grain-oriented electrical steel sheet produced by the current production process. The inner oxide layer is formed on the steel surface by decarburization annealing. In addition, the glass film is formed on the above inner oxide layer during the final annealing, which reacts $SiO_2$ with MgO, to avoid having windings of the coil stick to each other.

Since this glass film is formed based on the above inner oxide layer, the interface between the glass film and the steel sheet is not smooth because of the presence of precipitates. As a result, these precipitates become a hindrance to movement of the magnetic domains. This phenomenon is well known from the various reports, for example, by S. D. Washko, T. H. Shen and W. G. Morris, Journal of Applied Physics., vol. 53, pp 8296–8298. Since then, there have been proposed various methods for dealing with this phenomenon. For example, one of the methods is to prevent glass film formation during the final annealing, and another is to obtain an even and smooth steel surface by chemical or mechanical polishing after removal of the glass film. When coarse and highly pure alumina, which is a non-hydrating oxide, is used as an annealing separator in the final annealing, no glass film is formed on the steel surface of the resulting product. This is disclosed in U.S. Pat. No. 3,785,882.

However, the improvement in core loss shown is only 2% at most because of the residue of precipitates present directly below the steel surface and of the uneven surface after the final annealing.

To achieve a mirror surface by elimination of the remaining precipitates present directly below the steel surface, it is known to use a treatment by chemical or electrolytic polishing, as disclosed in Japanese Unexamined Patent Publication Nos. 49-96920 and 60-39123. These methods are suitable for treating small samples in laboratories, but have not yet been practiced in commercial scale production. This is because of the management of the chemical concentration is very difficult and a waste treatment system is required.

With respect to the production of a grain-oriented electrical steel sheet having a mirror finish steel surface free of precipitates, the present inventors previously proposed a method for preventing the formation of precipitates directly below the steel surface by means of coating an annealing separator mainly composed of alumina after elimination of the oxide layer formed on the decarburized steel sheet by pickling, as described in Japanese Unexamined Patent Publication No. 6-256848. According to this method, core loss can be decreased by 0.1 w/kg at $W_{17/50}$, in comparison with the case in which the oxide layer is not eliminated. Although it is possible to practice the pickling at an industrial scale according to the above mentioned method, this requires an additional investment in pickling facilities and increases the production cost. Therefore, a strong need exists for development of a grain-oriented electrical steel sheet, having a mirror surface for decreasing core loss, by a simplified process and at low production cost.

SUMMARY OF THE INVENTION

A primary object of the present invention is to provide a grain-oriented electrical steel sheet having a mirror surface and reduced core loss, free of precipitates directly below the surface. A further object of the present invention is to provide a simplified process that lowers production cost by elimination of the acid pickling step.

The present inventors conducted numerous experiments aimed at overcoming the defects of the conventional techniques and attaining the foregoing object, to develop a more effective production process for obtaining a miller steel surface free of precipitates directly below the surface of the grain-oriented electrical steel sheet products.

In this research, the present inventors found that if the amount of impurities contained in the oxide used as an annealing separator, especially the concentration of alkali metals, is controlled in accordance with the amount of oxygen which is contained in the steel sheet during the decarburization annealing, the formation of precipitates, which increases core loss, can be prevented from the start and furthermore, formation of a mirror surface can be promoted in the final annealing step.

In accordance with the present invention, there is provided a grain-oriented electrical steel sheet having a mirror surface with low core loss by means of using an annealing separator mainly composed of non-hydrating oxides and controlling the concentration of alkali metal impurities in the annealing separator and the oxygen amount in the steel sheet just prior to the final annealing, for achieving a decreased core loss. More specifically, in accordance with the present invention, a mirror surface is obtained by satisfying the relationship:

$[A]>0.2\times[O]$, where [A] is the total concentration of alkali metal impurities in an annealing separator (weight %) and [O] is the oxygen content in the steel sheet just prior to the final annealing ($g/m^2$).

Furthermore, the present invention provides a non-hydrating oxide contained in an annealing separator mainly composed of alumina for obtaining a mirror steel surface and reduced core loss.

Moreover, the above mentioned alkali metal impurities consist of at least one of Li, Na and K. The annealing separator further contains at least one of hydroxide, nitrate, sulfate, chloride or acetate of Li, Na or K.

Therefore, a mirror steel surface free of precipitates directly below the surface can be easily obtained by a simplified process for decreasing core loss, especially hysterisis loss.

DESCRIPTION OF THE PREFERRED EMBODIMENTS

The present inventors used various kinds of alumina, the oxide which is commonly used as an annealing separator, and found that Na as an impurity contained in alumina influenced the formation of precipitates and the mirror condition of the steel surface. This is because when a large amount of Na is present, the mirror surface can be obtained even if an oxide film exists. In addition, no precipitates are observed directly below the steel surface when the steel surface exhibits the mirror condition. The present inventors have not ascertained the reason for this. It is thought that reduction of $SiO_2$ formed during the decarburization annealing may be accelerated in the final annealing step because of the existence of Na. If the reduction of $SiO_2$ easily occurs in the final annealing step, the precipitates directly below the steel surface, once formed, decrease and disappear. Otherwise they are not formed from the start. As a result, a mirror steel surface can be easily obtained.

In the production of a grain-oriented electrical steel sheet, carbon is an essential element for obtaining the required crystal texture in the intermediate product so as to preferentially promote {110}<001> crystal orientation in the final product. Though this carbon must be included in the required amount in the early production stage, the carbon remaining in the final product increases the core loss. Accordingly, a primary recrystallization annealing is carried out in a wet hydrogen/nitrogen mixed atmosphere for decaburization. This primary recrystallization annealing is ordinarily called decaburization annealing. The concentration of the remaining carbon in the final product must be limited to less than 30 ppm.

Generally, the speed of the decarburizing reaction depends upon the reaction potential of the oxygen in the decarburization atmosphere. When the reaction potential of the oxygen becomes low, the decarburizing reaction slows down. On the other hand, the reaction oxygen potential can be increased to form an inner oxide layer, mainly composed of $SiO_2$, on the surface of the electrical steel sheet. At present, the conditions enabling both completion of decarburization and formation of an inner oxide layer within the decarburization period, yet that does not reduce productivity, have not yet been found.

Figure 3A:
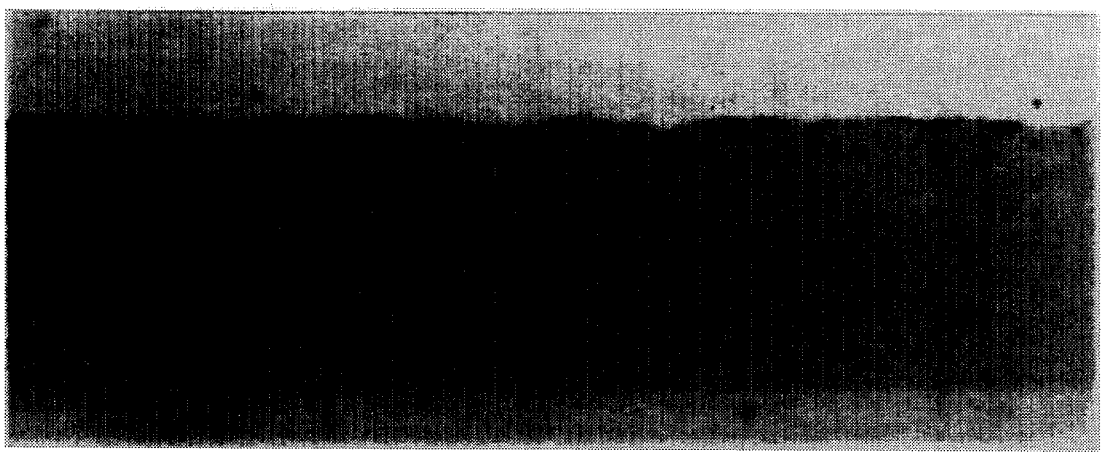
FIG. 3 is a micrograph showing a cross sectional view of a grain-oriented electrical steel sheet which was coated by alumina as an annealing separator, and then final annealed. (a) shows an example of the case of using high purity alumina. (b) shows an example of the case of using alumina containing 0.2 weight % of Na as impurity.

Therefore, decarburized annealed steel sheets treated under normal conditions have inevitably included an inner oxide layer mainly composed of $SiO_2$. As mentioned above, if a coat of coarse and high purity alumina is applied to the decarburized steel sheet having the inner oxide layer, and given a final annealing, a grain-oriented electrical steel sheet having no oxide film on the surface can be obtained. However, the thus obtained steel sheet not only exhibits a mirror steel surface but also has precipitates present directly below the steel surface. These precipitates are clearly observed in the microscopic sectional view of the steel surface as shown in FIG. 3(a).

The chemical configuration of these precipitates formed directly below the steel surface depends upon whether or not sol Al is contained in the steel sheet prior to the final annealing. When sol Al is contained in the steel sheet prior to the final annealing, it is observed by X-ray diffraction (CuKα) microscopy that the formed precipitate is mainly composed of mullite ($3Al_2O_3.2SiO_2$). On the other hand, when sol Al is not contained in the steel sheet prior to the final annealing, observation of the residue by infrared spectroscopy shows that the formed precipitate is mainly composed of $SiO_2$.

Since the amount of the precipitate formed directly below the steel surface increases with rise of the dew point during the decarburization annealing, the origin of the $SiO_2$ contained among these precipitates is thought to be the inner oxide layer containing $SiO_2$ formed during the decarburization annealing. On the other hand, the origin of the $Al_2O_3$ contained among the precipitates is assumed to be the sol Al contained in the steel sheet for controlling the secondary recrystallization, and to be the alumina used as an annealing separator. This is because the precipitates are not exposed on the steel surface. From the above described facts, it will be understood that the $SiO_2$ inner oxide layer formed during the decarburization annealing remains directly below the steel surface, so that this $SiO_2$ is not reduced by the reducing atmosphere during the final annealing. Especially, when sol Al is contained in the steel sheet, this sol Al reacts with the $SiO_2$ and forms mullite directly below the steel surface. Since these precipitates are present inside the steel sheet, they are not reduced under the condition of the reducing atmosphere at a high temperature in the latter half of the final annealing. If these precipitates are not present at the steel surface, atomic diffusion is vigorously promoted so that the formation of a mirror finish is accelerated. On the other hand, if these precipitates are present directly below the steel surface, the promotion of atomic diffusion is prevented so that the formation of a mirror finish is also prevented during the final annealing.

Considering the above mentioned mechanism regarding the formation of the precipitates directly below the steel surface during the final annealing, problems always occur in the production of a grain-oriented electrical steel sheet under the following conditions: (1) when the steel contains Si, (2) when the decarburization annealing is necessary, and (3) when a mirror surface is formed without forming a glass film containing forsterite during the final annealing. Therefore, the present invention can be basically applied to the production of all kinds of grain-oriented electrical steel sheet on the premise of the above mentioned conditions (1)–(3).

Figure 1A:
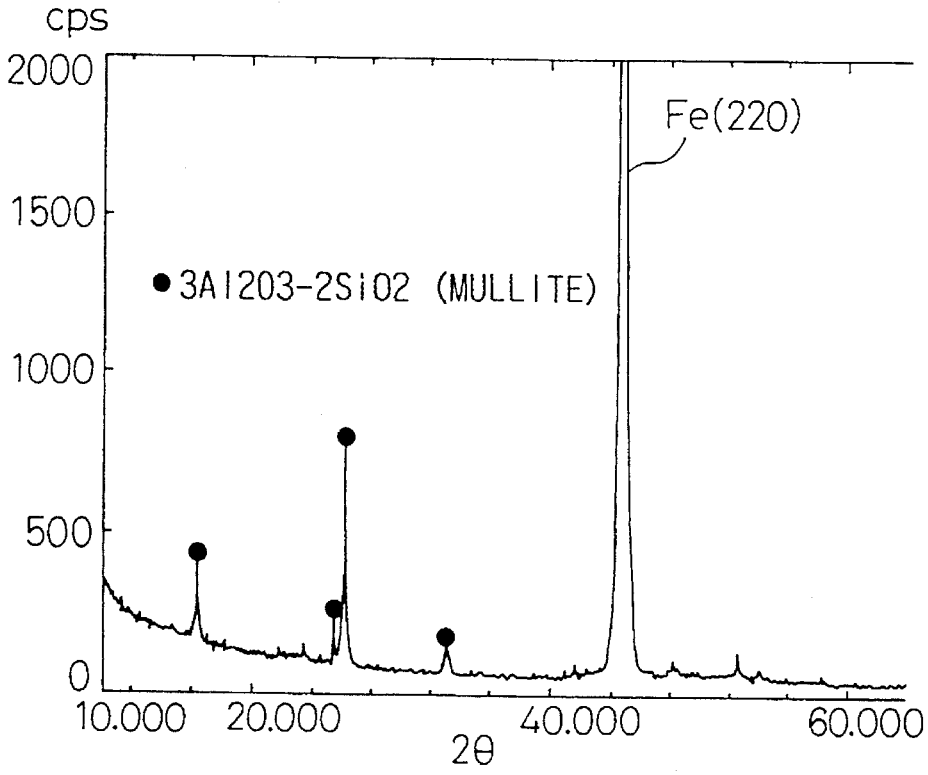
FIG. 1 shows the results of X-ray diffraction (CuKα) microscopy of a grain-oriented electrical steel sheet, coated with alumina as an annealing separator, and then given a final annealing. (a) shows an example of the results of X-ray diffraction analysis (CuKα) in the case of using high purity alumina. (b) shows an example of the results of X-ray diffraction analysis (CuKα) of in the case of using alumina containing 0.2 weight % of Na as impurity.
Figure 1B:
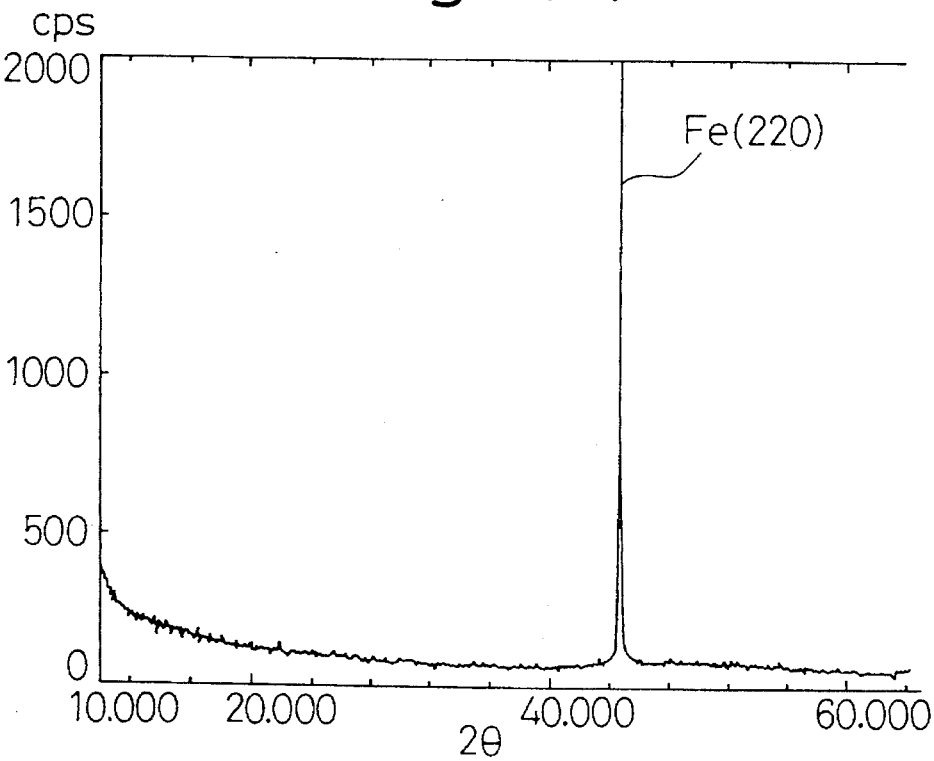
Figure 3B:
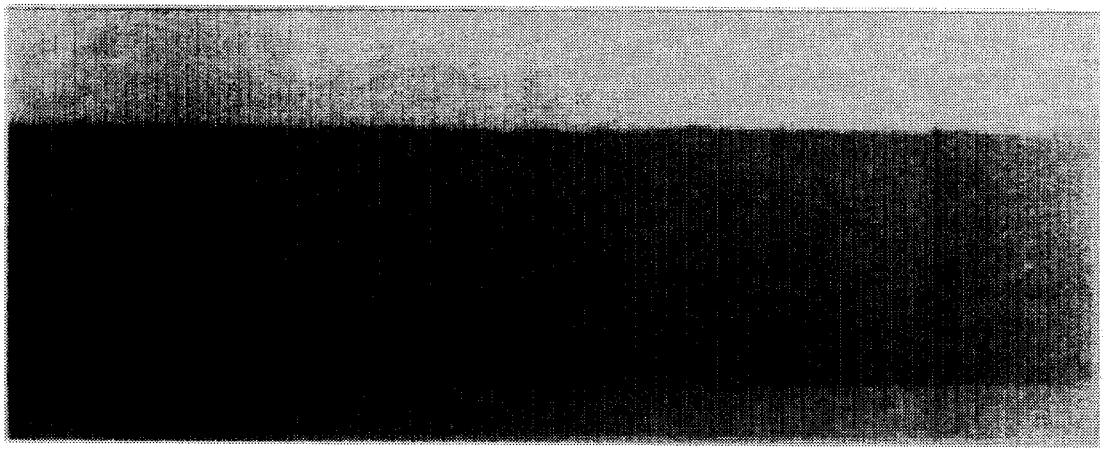

The present inventors used various kinds of alumina, the oxide which is commonly used as an annealing separator, containing different amounts of impurities such as Na, K or Li and/or their compounds, and found that when Na is contained in alumina as an impurity, it influences the formation of precipitates and the condition of the mirror brightness, even if an oxide film is present. In addition, this phenomenon depends upon the amount of Na. Accordingly, when alumina containing a large amount of Na was used as an annealing separator, no precipitates were found directly below the steel surface, and a mirror surface was obtained. This phenomenon is clearly observed in the microscopic views of FIG. 3(*a*) and FIG. 1(*b*). The present inventors have not yet clarified the reason for this. They assume that reduction of $SiO_2$ formed during the decarburization annealing may be accelerated in the final annealing step because of the presence of Na. If the reduction of $SiO_2$ easily occurs in the final annealing step, the precipitates formed directly below the steel surface decrease and disappear, or are not formed in the first place. As a result, a mirror surface ca be easily obtained if alumina containing a large amount of Na is used as an annealing separator.

Figure 2:
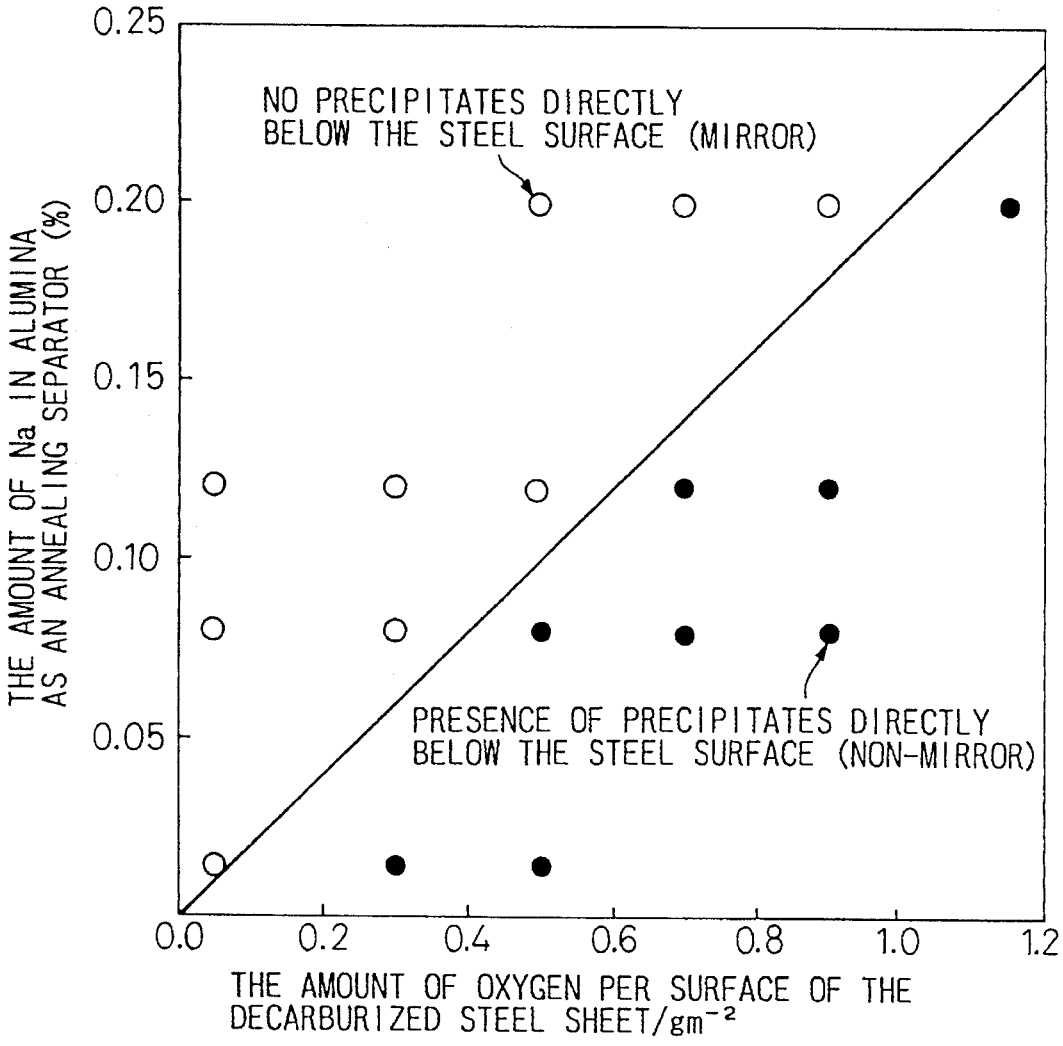
FIG. 2 is a diagram illustrating the relationship between the amount of Na in alumina as an annealing separator and the oxygen content of the steel sheet during the decarburization annealing, and the formation of precipitates directly below the steel surface. "o" indicates absence of precipitates and "•" indicates presence of precipitates.

From a further study relating to the concentration of Na in the alumina required for preventing the formation of the precipitates directly below the steel surface, it was found that the presence of the precipitates depends upon the oxygen content in the decarburization annealing. The concentration of Na in the alumina and the state of precipitation of the precipitates directly below the steel surface are shown in FIG. 2. If the oxygen content in the decarburized steel sheet is small, the required amount of Na will be small. This leads to the following relationship.

$$[A]>0.2\times[O]$$

where [A] is the concentration of Na in the alumina used as an annealing separator (weight %), and [O] is the oxygen content of each surface of the decarburized steel sheet (g/m). Therefore, if the decarburized steel sheet and the annealing separator satisfy the above relationship, the resultant product is free of precipitates and has a mirror surface.

In order to satisfy the above relationship for Na contained in the alumina to be used an annealing separator, it is better to decrease the dew point of the decarburizing annealing atmosphere, or to eliminate the oxide film by light acid pickling after the decarburization annealing. Furthermore, in order to satisfy the above relationship under the oxygen content for the decarburized steel sheet, it is better to select alumina containing an appropriate amount of Na as an impurity, or to add a required amount of any of various sodium compounds such as sodium oxide, hydroxide, chloride, sulfate or nitrate etc., to the alumina. In each of the above cases, the mirror surface can be obtained. With respect to the effect of impurities other than Na contained in alumina, alkali metals such as Li and K etc., show the same effects as Na. Accordingly, a lithium compound or potassium compound can be added to the alumina.

In the actual production of a grain-oriented electrical steel sheet to which the present invention is applicable, a typical conventional processes can be used. These include the N. P. Goss et al. process using MnS as the main inhibitor disclosed in U.S. Pat. No. 1,965,559, the Taguchi, Sakakura et al. process using AlN and MnS as the main inhibitor disclosed in U.S. Pat. No. 3,287,183 and the Komatsu et al. process using (Al, Si)N as the main inhibitor disclosed in Japanese Patent Publication No. Sho 60-45285 (Kokoku). The following explains the steel composition and the amount used in the present invention.

Carbon is an element required for $\gamma$ phase formation, and is necessary for controlling the primary recrystallization texture prior to the final annealing for ensuring an appropriate secondary recrystallization. Therefore, carbon must be contained in the cold rolled steel sheet in the range of 0.02–0.1%. If the carbon content is more than 0.1%, the primary recrystallized texture deteriorates and a long period of time is required for decarburization.

Silicon is an important element for increasing electric resistance and decreasing core loss. If the silicon content is less than 0.8%, $\alpha$ to $\gamma$ transformation occurs during final annealing and the crystal structure and the orientation are impaired, while if the silicon content is more than 4.8%, cold rolling becomes difficult because of cracking. The preferred silicon content is from 0.8% to 4.8%.

Manganese and sulfur form an inhibitor which suppresses primary grain growth. In order to assure stable secondary recrystallization, the manganese and sulfur contents must each be limited to the range of 0.005–0.04%.

Acid soluble aluminum is a basic element which combines with nitrogen to form AlN or (Al, Si)N as an inhibitor for obtaining a high magnetic flux density. The preferred acid soluble alumina content is from 0.012 to 0.05%.

Nitrogen is also a basic element which combines with the acid soluble aluminum to form an inhibitor. If the nitrogen content is more than 0.01%, blisters are undesirably formed in the final product. The preferred nitrogen content is not more than 0.01%.

Other elements can be used to form inhibitors, such as B, Bi, Pb, S, Se, Sn or Ti, in addition to the acid soluble aluminum.

A hot rolled steel strip adjusted to the composition range mentioned above by a known process is cold rolled directly or with hot rolled band annealing in a short period of time. This hot rolled band annealing is effective for improving the magnetic properties of the final product, and is carried out at a temperature between 750° C. and 1200° C. for 30 seconds to 30 minutes. The annealing conditions are determined based on the desired product quality or cost.

In the case of using the AlN or (Al, Si)N as the inhibitors, the cold rolling is carried out at a reduction rate of more than 80% to the final thickness by a known cold rolling process as described in Japanese Patent Publication (Kokoku) No. Sho 40-15644. The condition of the cold rolling is of course variable depending upon the inhibitors used.

Then the decarburization annealing is carried out on the cold rolled steel strip in a wet atmosphere at a temperature between 750° C. and 900° C. for primary recrystallization and the removal of carbon from the cold rolled steel strip. The nitriding treatment is carried out following the decarburization annealing in the case of using (Al, Si)N as the main inhibitor. The nitriding treatment is carried out in an atmospheric gas containing $NH_3$ having nitriding capability. The nitriding amount is more than 0.005% to the total amount of nitrogen contained in the steel sheet, preferably more than the aluminum equivalent of the steel sheet.

Subsequently, an annealing separator is coated on the decarburized or nitrided steel strip to form a glass film during the final annealing and prevent sticking. The annealing separator can be used in the present invention is an oxide which is hard to hydrate. If an oxide which is easy to hydrate, like MgO, is used, peroxidation occurs at the steel surface during the final annealing or an oxide layer forms on the steel surface by reaction with the oxide film formed by decarburizing, so that a mirror surface cannot be obtained.

If the annealing separator is a stable oxide having a non-hydrating characteristic, it is not limited to a specific oxide. An oxide like $ZrO_2$ or $Y_2O_3$ can be used.

Alumina is a suitable oxide for the present invention because of its non-hydrating characteristic and low cost. It is advisable to use inexpensive alumina because it contains a large amount of sodium. This annealing separator is applied as a slurry in the conventional way or by electrostatic coating. When the annealing separator is suspended in water, it is desirable to add an anti-corrosion agent to the suspension, to prevent rusting of the steel surface during the coating. In the case of using relatively coarse oxide particles suspended in water, a caking agent such as methylcellulose is added to improve the coating ability and adhesibility.

The specific requirement for obtaining a mirror surface according to the present invention is that the condition defined as follows must be satisfied during the decarburization annealing and the coating with the annealing separator. The condition is the relationship; $[A]>0.2\times[O]$, where [O] is the amount of oxygen ($g/m_2$) contained in the steel sheet just prior to the final annealing and [A] is the total concentration of alkali metal impurities (weight %) in the annealing separator.

It is possible to achieve the above mentioned condition by the following means. When an oxide having a low concentration of alkali metal impurity is used as the annealing separator, the oxygen content in the steel sheet can be reduced by a light acid pickling treatment after the decarburization annealing. However, this method is not recommendable from the point of view of production cost because it requires an additional step. In the decarburization annealing operation, the non-hydrating oxide containing the alkali metal impurity as the annealing separator can be used in accordance with the amount of generated oxygen contained in the steel sheet when the decarburization is almost completed, and selecting an appropriate atmosphere and annealing period which prevent the oxidation of the steel sheet.

The following means can be used for securing the necessary concentration of the alkali metal impurity of the non-hydrating oxide as the annealing separator. The commercial low priced alumina generally used naturally contains Na as an impurity, approximately in an amount of 0.2%, due to its production process. Therefore, this inexpensive commercial alumina is very useful as the annealing separator for achieving the object of the present invention. When the amount of Na impurity contained in the alumina is insufficient compared with the oxidized amount of the steel sheet, or a non-hydrating oxide without an alkali metal impurity is used as the annealing separator, an alkali metal chloride (or salt) is added to the oxide powder or an alkali metal chloride (or salt) is dissolved in the necessary amount in the slurry for making the annealing separator. For the alkali metal chloride (or salt), it is advisable to use a water soluble salt selected from the group consisting of hydroxide, nitrate, sulfate, chloride or acetate of Na, K, or Li etc.

Finally, the final annealing is carried out for secondary recrystallization and purification after the annealing separator is coated. A specific heating cycle which maintains a constant temperature for promoting the secondary recrystallization during the heating step is effective for increasing the magnetic flux density as described in Japanese Unexamined Patent Publication (Kokai) No. 2-258929.

After the secondary recrystallization is completed in the final annealing, the heated steel strip is kept at a temperature higher than 1100° C. in a 100% hydrogen atmosphere for the purification of nitride and a mirror conditioning the steel surface.

An insulation coating is applied to the steel strip for imparting a tensioning effect and reducing core loss. In addition, magnetic domain refining treatment by the laser irradiation may be applied for further reducing core loss.

The present invention will now be described in detail with reference to the following examples, that by no means limit the scope of the invention. The present invention will be applicable to other steel compositions or other production process as already described as far as satisfying the following conditions independently or altogether; (1) the steel contains Si, (2) decarburization annealing is necessary, and (3) a mirror surface is formed without glass film containing forsterite during the final annealing in the production of a grain-oriented electrical steel sheet.

Example 1

A grain-oriented electrical steel material containing 0.05% by weight of C, 3.3% by weight of Si, 0.1% by weight of Mn, 0.007% by weight of S, 0.03% by weight of sol Al, 0.008% by weight of N, and 0.05% by weight of Sn, with the balance comprising Fe and unavoidable impurities, was processed by ordinary production steps, i.e., hot rolling to a thickness of 2.3 mm, hot rolled strip annealing at a temperature of 1100° C. for 2 minutes, and cold rolling to a final thickness of 0.23 mm with acid pickling. Thereafter, the thus obtained cold rolled strip was treated by decarburization annealing in various atmospheres for different annealing times. The amount of oxygen in the steel sheet is shown in Table 1. Then, the nitriding treatment was carried out in an $NH_3$ atmosphere gas bringing the nitrogen content in the steel sheet to 0.025% for strengthening inhibitors. Subsequently, an annealing separator was coated onto the nitrided steel sheet. Conventional MgO was applied to several steel sheets, and alumina containing different kinds of alkali metal as impurities and different concentrations in the slurry state were applied to the remaining steel sheets. Then, final annealing was carried out by heating the steel sheets to 1200° C. at a constant heating rate of 10° C./hr in an atmosphere of 100% nitrogen gas, and by maintaining them at a temperature of 1200° C. for 20 hours in an atmosphere of 100% hydrogen gas. The atmosphere gas was switched from nitrogen to hydrogen at 1200° C. Finally, insulation coating and the magnetic domain refinement treatment by laser irradiation were applied to the finally annealed sheets. The resultant products had the magnetic properties as shown in Table 1.

TABLE 1

| | Amount of oxygen per surface ($g/m^2$) | Kind of annealing separator | Na Concentration of impurity in annealing separator (wt %) | Amount of alkali metal added to annealing separator (wt %) | Method of alkali metal addition | Condition of the steel surface | Yes or No of precipitates directly below the surface | Magnetic Properties $B_8$ (T) | $W_{17/50}$ (w/kg) |
|---|---|---|---|---|---|---|---|---|---|
| Comparative Example 1 | 0.7 | MgO | — | — | — | glass film | — | 1.91 | 0.80 |
| Comparative Example 2 | 0.7 | $Al_2O_3$ | 0.12 | — | — | non-mirror | Yes | 1.92 | 0.81 |
| Present Invention 1 | 0.7 | $Al_2O_3$ | 0.20 | — | — | mirror | No | 1.94 | 0.63 |
| Present Invention 2 | 0.5 | $Al_2O_3$ | 0.05 | 0.10 | NaOH addition | mirror | No | 1.94 | 0.63 |
| Comparative Example 3 | 0.3 | $Al_2O_3$ | 0.03 | — | — | non-mirror | Yes | 1.95 | 0.79 |
| Present Invention 3 | 0.3 | $Al_2O_3$ | 0.03 | — | — | mirror | No | 1.95 | 0.62 |
| Present Invention 4 | 0.3 | $Al_2O_3$ | 0.03 | 0.05 | KOH addition | mirror | No | 1.96 | 0.61 |
| Present Invention 5 | 0.3 | $Al_2O_3$ | 0.03 | 0.05 | LiOH addition | mirror | No | 1.96 | 0.62 |
| Comparative Example 4 | 0.2 | $Al_2O_3$ | 0.015 | — | — | non-mirror | Yes | 1.94 | 0.80 |
| Present Invention 6 | 0.2 | $Al_2O_3$ | 0.08 | — | — | mirror | No | 1.97 | 0.58 |
| Present Invention 7 | 0.2 | $Al_2O_3$ | 0.015 | 0.05 | NaCl addition | mirror | No | 1.96 | 0.61 |
| Present Invention 8 | 0.2 | $Al_2O_3$ | 0.015 | 0.05 | $NaNH_3$ addition | mirror | No | 1.96 | 0.60 |
| Present Invention 9 | 0.2 | $Al_2O_3$ | 0.015 | 0.05 | Potassium acetate addition | mirror | No | 1.95 | 0.62 |

Example 2

A grain-oriented electrical steel material containing 0.07% by weight of C, 3.3% by weight of Si, 0.07% by weight of Mn, 0.025% by weight of S, 0.026% by weight of sol Al, 0.008% by weight of N, and 0.1% by weight of Sn, with the balance comprising Fe and unavoidable impurities, was processed by ordinary production steps, i.e., hot rolling to a thickness of 2.3 mm, hot rolled strip annealing at a temperature of 1100° C. for 2 minutes, and cold rolling to a final thickness of 0.23 mm with acid pickling. Thereafter, the thus obtained cold rolled strip was treated by decarburization annealing in various atmospheres for different annealing times. The amount of oxygen in the steel sheet is shown in Table 2.

Subsequently, an annealing separator was applied to the decarburized steel strip. Conventional MgO was applied to several steel sheets, and alumina containing different kinds of alkali metal as impurities and different concentrations in the slurry is applied to the remaining steel sheets. Then, final annealing was carried out by heating the steel sheets to 1200° C. at a constant heating rate of 15° C./hr in a mixed atmosphere comprising 15% nitrogen and 85% hydrogen gas, and further maintaining the steel at a temperature of 1200° C. for 20 hours in an atmosphere of 100% hydrogen gas. The atmosphere gas was switched from nitrogen to hydrogen at 1200° C. Finally, insulation coating and the magnetic domain refining treatment by laser irradiation were applied to the final annealed strip. The resultant products had the magnetic properties as shown in Table 2.

TABLE 2

| | Amount of oxygen per surface ($g/m^2$) | Kind of annealing separator | Na Concentration of impurity in annealing separator (wt %) | Amount of alkali metal added to annealing separator (wt %) | Method of alkali metal addition | Condition of the steel surface | Precipitates directly below the surface | Magnetic Properties $B_8$ (T) | $W_{17/50}$ (w/kg) |
|---|---|---|---|---|---|---|---|---|---|
| Comparative Example 1 | 0.7 | MgO | — | — | — | glass film | — | 1.90 | 0.81 |
| Comparative Example 2 | 0.7 | $Al_2O_3$ | 0.12 | — | — | non-mirror | Yes | 1.92 | 0.80 |
| Present Invention 1 | 0.7 | $Al_2O_3$ | 0.20 | — | — | mirror | No | 1.93 | 0.65 |
| Present Invention 2 | 0.5 | $Al_2O_3$ | 0.05 | 0.10 | NaOH addition | mirror | No | 1.93 | 0.66 |
| Comparative Example 3 | 0.3 | $Al_2O_3$ | 0.03 | — | — | non-mirror | No | 1.94 | 0.78 |
| Present | 0.3 | $Al_2O_3$ | 0.08 | — | — | mirror | No | 1.96 | 0.60 |

TABLE 2-continued

| | Amount of oxygen per surface ($g/m^2$) | Kind of annealing separator | Na Concentration of impurity in annealing separator (wt %) | Amount of alkali metal added to annealing separator (wt %) | Method of alkali metal addition | Condition of the steel surface | Precipitates directly below the surface | Magnetic Properties $B_8$ (T) | $W_{17/50}$ (w/kg) |
|---|---|---|---|---|---|---|---|---|---|
| Invention 3 | | | | | | | | | |
| Present Invention 4 | 0.3 | $Al_2O_3$ | 0.03 | 0.05 | KOH addition | mirror | No | 1.95 | 0.61 |
| Present Invention 5 | 0.3 | $Al_2O_3$ | 0.03 | 0.05 | LiOH addition | mirror | No | 1.95 | 0.62 |
| Comparative Example 4 | 0.2 | $Al_2O_3$ | 0.015 | — | — | non-mirror | Yes | 1.94 | 0.80 |
| Present Invention 6 | 0.2 | $Al_2O_3$ | 0.08 | — | — | mirror | No | 1.95 | 0.60 |
| Present Invention 7 | 0.2 | $Al_2O_3$ | 0.015 | 0.05 | NaCl addition | mirror | No | 1.96 | 0.60 |
| Present Invention 8 | 0.2 | $Al_2O_3$ | 0.015 | 0.05 | $NaNH_3$ addition | mirror | No | 1.95 | 0.61 |
| Present Invention 9 | 0.2 | $Al_2O_3$ | 0.015 | 0.05 | Potassium acetate addition | mirror | No | 1.96 | 0.62 |

Example 3

A grain-oriented electrical steel material containing 0.05% by weight of C, 3.3% by weight of Si, 0.07% by weight of Mn, and 0.025% by weight of S, with the balance comprising Fe and unavoidable impurities, was processed by ordinary production steps, i.e., hot rolling to a thickness of 2.5 mm with acid pickling, and cold rolling to a final thickness of 0.30 mm with intermediate annealing at a temperature of 900° C. for 2 minutes. Thereafter, the thus obtained cold rolled strip was treated by decarburization annealing in various atmospheres and different annealing times. The amount of oxygen in the steel sheet is shown in Table 3. Subsequently, an annealing separator was applied to the decarburized steel strip.

Conventional MgO is applied to several steel sheets, and alumina containing different kinds of alkali metal as impurities and different concentrations in the slurry state is applied to the remaining steel sheets. Then, final annealing was carried out by heating the steel sheets to 1200° C. at a constant heating rate of 15 ° C./hr in a mixed atmosphere comprising 15% nitrogen and 85% hydrogen and by maintaining the steel at a temperature of 1200° C. for 20 hours in an atmosphere of 100% hydrogen gas. The atmosphere gas is switched from nitrogen to hydrogen at 1200° C. Finally, insulation coating and the magnetic domain refinement treatment by laser irradiation were applied to the final annealed sheet. The resultant product had the magnetic properties as shown in Table 3.

TABLE 3

| | Amount of oxygen per surface ($g/m^2$) | Kind of annealing separator | Na Concentration of impurity in annealing separator (wt %) | Amount of alkali metal added to annealing separator (wt %) | Method of alkali metal addition | Condition of the steel surface | Precipitates directly below the surface | Magnetic Properties $B_8$ (T) | $W_{17/50}$ (w/kg) |
|---|---|---|---|---|---|---|---|---|---|
| Comparative Example 1 | 0.7 | MgO | — | — | — | glass film | — | 1.85 | 1.21 |
| Comparative Example 2 | 0.7 | $Al_2O_3$ | 0.12 | — | — | non-mirror | Yes | 1.87 | 1.17 |
| Present Invention 1 | 0.7 | $Al_2O_3$ | 0.20 | — | — | mirror | No | 1.87 | 1.07 |
| Present Invention 2 | 0.5 | $Al_2O_3$ | 0.05 | 0.10 | NaOH addition | mirror | No | 1.86 | 1.06 |
| Comparative Example 3 | 0.3 | $Al_2O_3$ | 0.03 | — | — | non-mirror | Yes | 1.87 | 1.17 |
| Present Invention 3 | 0.3 | $Al_2O_3$ | 0.08 | — | — | mirror | No | 1.87 | 1.07 |
| Present Invention 4 | 0.3 | $Al_2O_3$ | 0.03 | 0.05 | KOH addition | mirror | No | 1.86 | 1.07 |
| Present Invention 5 | 0.3 | $Al_2O_3$ | 0.03 | 0.05 | LiOH addition | mirror | No | 1.86 | 1.07 |
| Comparative Example 4 | 0.2 | $Al_2O_3$ | 0.015 | — | — | non-mirror | Yes | 1.86 | 1.18 |
| Present Invention 6 | 0.2 | $Al_2O_3$ | 0.08 | — | — | mirror | No | 1.87 | 1.06 |
| Present Invention 7 | 0.2 | $Al_2O_3$ | 0.015 | 0.05 | NaCl addition | mirror | No | 1.87 | 1.07 |

TABLE 3-continued

| | Amount of oxygen per surface ($g/m^2$) | Kind of annealing separator | Na Concentration of impurity in annealing separator (wt %) | Amount of alkali metal added to annealing separator (wt %) | Method of alkali metal addition | Condition of the steel surface | Precipitates directly below the surface | Magnetic Properties $B_8$ (T) | $W_{17/50}$ (w/kg) |
|---|---|---|---|---|---|---|---|---|---|
| Present Invention 8 | 0.2 | $Al_2O_3$ | 0.015 | 0.05 | $NaNH_3$ addition | mirror | No | 1.86 | 1.07 |
| Present Invention 9 | 0.2 | $Al_2O_3$ | 0.015 | 0.05 | Potassium acetate addition | mirror | No | 1.86 | 1.07 |

We claim:

1. In a method for producing a grain-oriented electrical steel sheet having a mirror surface containing 0.8 to 4.8% of Si in the form of a strip which has been subjected to a conventional series of operations including hot rolling with or without annealing, cold rolling once or at least twice with intermediate annealing to obtain a final thickness, decarburization annealing with or without nitriding treatment, coating with an annealing separator mainly containing non-hydrating oxide, and final annealing, the improvement comprising:

satisfying the relationship $[A]>0.2\times[O]$ where [A] is the total concentration of alkali metal content in the annealing separator (weight %), and [O] is the amount of oxygen contained in the steel sheet just prior to the final annealing ($g/m^2$).

2. In a process for producing a grain-oriented electrical steel sheet having a mirror surface containing 0.8 to 4.8% of Si, 0.012 to 0.05% of soluble Al, and less than 0.01% of N, in the form of a strip which has been subjected to a conventional series of operations including hot rolling with or without annealing, cold rolling once or at least twice with intermediate annealing to obtain a final thickness, decarburization annealing with nitriding treatment, coating with an annealing separator mainly containing non-hydrating oxide and final annealing, the improvement comprising:

satisfying the relationship $[A]>0.2\times[O]$ where [A] is the total concentration of alkali metal content of in the annealing separator (weight %), and

[O] is the amount of oxygen contained in the steel sheet just prior to the final annealing ($g/m^2$).

3. In a process for producing a grain-oriented electrical steel sheet having a mirror surface containing 0.8 to 4.8% of Si, 0.012 to 0.05% of soluble Al, less than 0.01% of N, 0.02 to 0.3% of Mn, and 0.005 to 0.040% of S, in the form of a strip which has been subjected to a conventional series of operations including hot rolling with or without annealing, cold rolling once or at least twice with intermediate annealing to obtain a final thickness, decarburization annealing, coating with an annealing separator mainly containing non-hydrating oxide and final annealing, the improvement comprising:

satisfying the relationship $[A]>0.2\times[O]$ where [A] is the total concentration of alkali metal content in the annealing separator (weight %), and

[O] is the amount of oxygen contained in the steel sheet just prior to the final annealing ($g/m^2$).

4. In a process for producing a grain-oriented electrical steel sheet having a mirror surface containing 0.8 to 4.8% of Si, 0.02 to 0.3% of Mn, and 0.005 to 0.040% of S, in the form of a strip which has been subjected to a conventional series of operations including hot rolling with or without annealing, cold rolling once or at least twice with intermediate annealing to obtain a final thickness, decarburization annealing, coating with an annealing separator mainly containing non-hydrorating oxide and final annealing, the improvement comprising:

satisfying the relationship $[A]>0.2\times[O]$ where [A] is the total concentration of alkali metal content in the annealing separator (weight %), and

[O] is the amount of oxygen contained in the steel sheet just prior to the final annealing ($g/m^2$).

5. A process according to claim 1, wherein the non-hydrating oxide is mainly composed of alumina.

6. A process according to claim 1, wherein the alkali metal content in an annealing separator is mainly composed of one or more metals selected from the group consisting of Li, Na or K.

7. A process according to claim 1, wherein the annealing separator contains one or more compounds selected from the group consisting of hydroxide, nitrate, sulfate, chloride or acetate of Li, Na or K.

* * * * *

UNITED STATES PATENT AND TRADEMARK OFFICE

CERTIFICATE OF CORRECTION

PATENT NO. : 5,509,976

DATED : April 23, 1996

INVENTOR(S) : Shuichi YAMAZAKI, et al.

It is certified that error appears in the above-indentified patent and that said Letters Patent is hereby corrected as shown below:

Column 2, line 32, delete "of" after "because".

Column 2, line 65, change "miller" to --mirror--.

Column 4, line 57, change "($3Al_2O_3.2SiO_2$)." to --($3Al_2O_3 \cdot 2SiO_2$).--.

Column 5, line 50, change "ca" to --can--.

Column 7, line 17, before "can" insert --that--.

Column 8, line 20, delete "a" and insert --of-- after "conditioning".

Column 14, line 35, change "non-hydrorating" to --non-hydrating--.

Signed and Sealed this

Tenth Day of September, 1996

Bruce Lehman

*Attest:*

BRUCE LEHMAN

*Attesting Officer*

*Commissioner of Patents and Trademarks*